US005586823A

United States Patent [19]

Carr

[11] Patent Number: 5,586,823

[45] Date of Patent: Dec. 24, 1996

[54] MAGNETIC STIRRING SYSTEM

[75] Inventor: Anthony H. Carr, Bedfordshire, Great Britain

[73] Assignee: Unipath Limited, Basingstoke, England

[21] Appl. No.: 373,254

[22] PCT Filed: Jul. 14, 1993

[86] PCT No.: PCT/GB93/01479

§ 371 Date: Mar. 9, 1995

§ 102(e) Date: Mar. 9, 1995

[87] PCT Pub. No.: WO94/02238

PCT Pub. Date: Feb. 3, 1994

[30] Foreign Application Priority Data

Feb. 17, 1993 [GB] United Kingdom ..... 93301171

[51] Int. Cl.[6] ..... B01F 13/08

[52] U.S. Cl. ..... 366/274

[58] Field of Search ..... 366/273, 274, 366/279; 422/224, 225

[56] References Cited

U.S. PATENT DOCUMENTS

| | | | |
|---|---|---|---|
| 2,350,534 | 6/1944 | Rosinger | 366/274 |
| 2,951,689 | 9/1960 | Asp et al. | 366/274 |
| 3,384,353 | 5/1968 | Worth | 366/274 |
| 5,120,135 | 6/1992 | Ullman | 366/273 |

*Primary Examiner*—Robert W. Jenkins
*Attorney, Agent, or Firm*—Cushman Darby & Cushman IP Group Pillsbury Madison & Sutro, LLP

[57] ABSTRACT

A magnetic stirrer wherein a relatively weakly magnetised disposable stirrer bar inside a closed container, for example a stirrer bar moulded wholly of non-isotropic ferrite, is moved with a stirring action from outside the container by a relatively powerful magnetic driver, preferably consisting of a pair of permanent magnets of neodymium boron driven in rotation as an assembly.

9 Claims, 1 Drawing Sheet

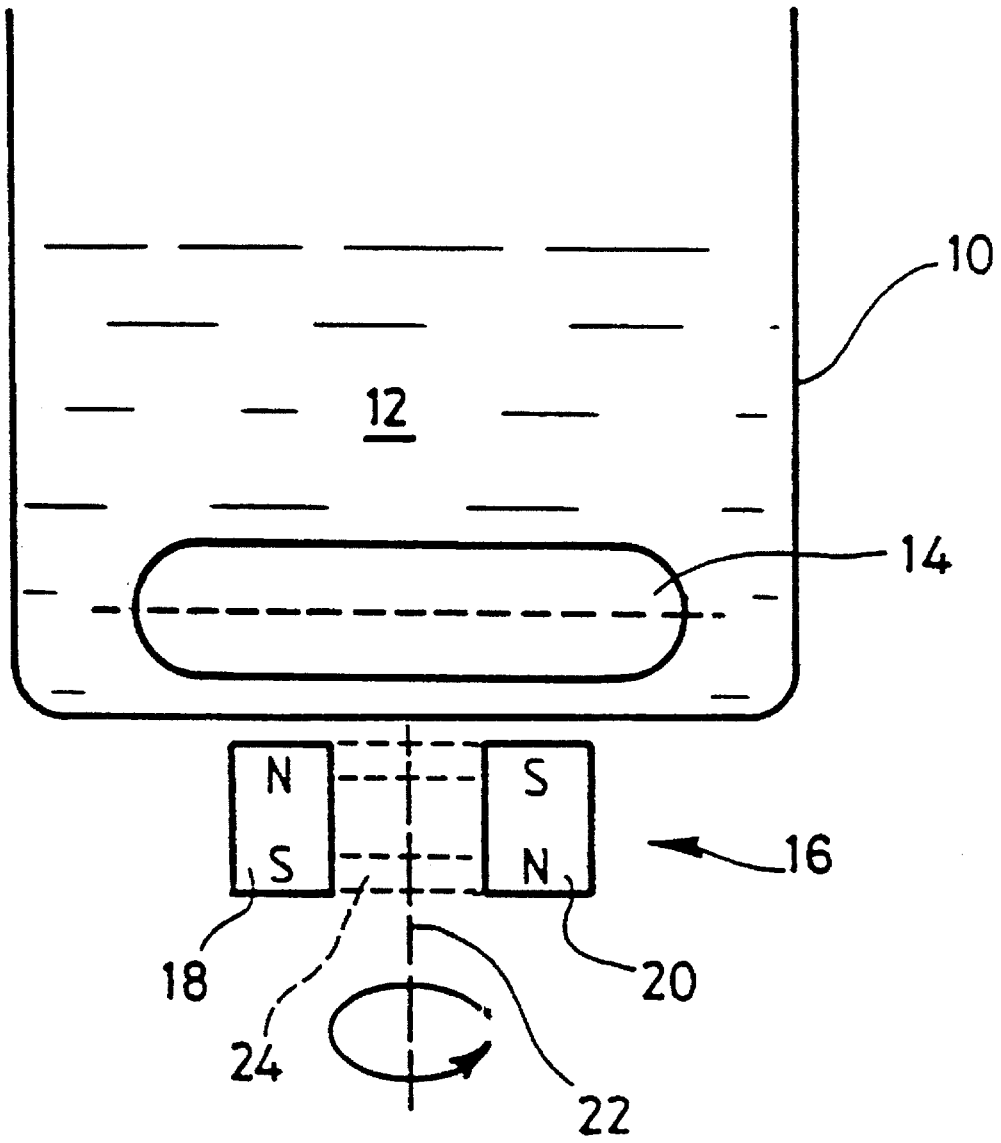
10
12
14
N
S
S
N
16
18
20
24
22

MAGNETIC STIRRING SYSTEM

FIELD OF THE INVENTION

This invention relates generally to a magnetic stirring system and in particular to a magnetic stirrer and a method of magnetically stirring a liquid within a closed culture bottle.

BACKGROUND TO THE INVENTION

Magnetic stirring of liquids within a closed bottle is a well known technique. A stirrer bar in the liquid to be stirred is moved with a stirring action by a magnetic field producing means outside the bottle. The magnetic field producing means outside the bottle may be motor driven magnets or solid state switched coils. The stirrer bar normally used hitherto in such systems is of relatively high quality, being strongly magnetised and costly to manufacture. Accordingly, it is normal to recover the stirrer bar after use and wash it for further use.

Known from German Specification No. 1 757 099 is a magnetic stirring means for a bank of test tubes. Stirrer bars of unquantified magnetisation are driven in unspecified motion by an external permanent magnetic means driven in rotation. Also known from U.S. Pat. No. 4,090,263 is a magnetic stirrer system in which a magnetisable stirrer bar is coupled to an external drive magnet. It is well understood, however, that in a closed culture bottle an essential aim of any stirrer system is to promote gas exchange with the bottle headspace by disturbing the liquid surface. It is not apparent that the known stirrer systems are able to achieve this aim.

However, there are applications for magnetic stirrers, such as the stirring of cultures in microbiology, where the fluid is often extremely hazardous and recovery of stirrer bars would require protected sterilisation. In such circumstances, removal of the stirrer bar from the culture bottle would be a very undesirable process. Furthermore, culture bottles are themselves a disposable product, and must be of cheap manufacture. The incorporation of expensive stirrer bars in such bottles has therefore not been considered a practicable procedure, so that magnetic stirring has not been considered possible in this field of application.

SUMMARY OF THE INVENTION

According to one aspect of the invention, there is provided a magnetic stirrer comprising a bottle unit constituted by a bottle having a base and a stirrer bar of relatively low power magnetisation lying on the bottle base within the bottle, and a permanent magnet means of relatively high power located beneath the bottle base in close proximity thereto, and driving means for continuously rotating the external permanent magnet means about an axis substantially normal to the bottle base so that its rotating strong magnetic field entrains the stirrer bar in continuous rotation in a plane parallel to and above the bottle base within the liquid in the container.

According to another aspect of the invention, there is provided a method of magnetically stirring a liquid within a bottle, wherein a stirrer bar of relatively low power magnetisation is inserted into the bottle to lie on the bottle base, a permanent magnet means of relatively high power is continuously driven in rotation beneath the bottle base in close proximity thereto and about an axis substantially normal to the bottle base, causing its rotating strong magnetic field to entrain the stirrer bar in continuous rotation in a plane parallel to and above the bottle base within the liquid in the container.

The invention is based on the realisation that an infallible magnetic coupling between an internal stirrer bar and an external magnetic driver can be achieved, with a low cost stirrer bar of low magnetisation, provided that the necessary coupling can be ensured by use of a high power magnetic drive.

In the field of blood culture bottles especially, a reliable magnetic coupling between the stirrer bar and its magnetic driving means is an essential requirement, because the bottle containing the sample is effectively opaque, so that visible checking of the operation of the stirrer bar is virtually impossible.

Because the stirrer bar is of relatively low power, it can be sufficiently cheaply made to be disposable with the liquid container. Preferably, therefore, the stirrer bar is moulded wholly of ferrite in non-isotropic form. A more powerfully magnetised bar using isotropic ferrite can be produced, but manufacture involves orientating the ferrite during moulding, and this is a costly procedure Such a more powerfully magnetised stirrer bar could therefore not be treated as disposable in the context of the market relating to culture bottles.

For the low power stirrer bar to be reliably driven with a stirring action, the external magnetic drive must be of such compensatory high power as to ensure a reliable magnetic coupling. This is preferably achieved by use of a pair of spaced high power magnets respectively with north and south poles adjacent the stirrer bar. Rare earth magnets are preferred, in particular of neodymium boron.

The stirrer bar is preferably magnetised along its longitudinal axis. The external permanent magnets, more especially of neodymium boron, then preferably extend generally normally to the base of the container with spaced centres, and the driving means acts to rotate the magnets about an axis parallel to the lengths of the magnets and generally central between said magnets.

A practical magnetic stirrer and method of magnetic stirring in accordance with the invention will now be described by way of example with reference to the accompanying drawing.

BRIEF DESCRIPTION OF THE DRAWING

The single FIGURE is a diagrammatic view of a magnetic stirrer in accordance with the present invention.

Referring to drawing, a container 10, for example a bottle containing a culture 12, for example a blood culture, has placed within it an inexpensive stirrer bar 14 consisting of a weak magnet moulded wholly of ferrite in non-isotropic form. Because the stirrer bar 14 is cheaply manufactured, it is disposable with the culture bottle 12 after use.

In use, the stirrer bar 14 is moved with a stirring action within the blood culture 12 by an external magnetic driver generally referenced 16. In order to compensate for the weak magnetic power of the stirrer bar 14, the magnetic driver 16 must be of very high power, and consists of two permanent magnets 18, 20 of neodymium boron, arranged in spaced parallel relationship one with its north pole and one with its south pole adjacent the stirrer bar. These strong permanent magnets 18, 20 are driven in rotation as an assembly about an axis 22.

Even stronger coupling with the stirrer bar 14 can be achieved if the permanent magnets 18, 20 are linked between poles by magnetisable material, as indicated in broken line at 24. The arrangement in effect forcibly couples with the stirrer bar 14, reliably drawing it into alignment with the permanent magnets 18, 20 and maintaining this alignment as the permanent magnets rotate. The extreme power of the permanent magnets 18, 20 dominates the coupling action.

Typically, the stirrer bar is a 20 mm long cylindrical component of 6 mm diameter, magnetised along its longitudinal axis, and the permanent magnets 18, 20 are each of 6 mm length and 4 mm diameter, being spaced at about 18 mm centres. In the illustrated example, the coupling action is achieved through the base of the bottle 10.

Although primarily described with reference to use in the field of stirring cultures, the invention is also useful in other fields, not only involving other hazardous liquids to be stirred which may make recovery of the stirrer bar undesirable, but as an alternative, for example, to the complex engineering to be found in shaker/incubators extensively used in microbiological laboratories.

I claim:

1. A magnetic stirrer comprising a bottle unit constituted by a closed culture bottle containing liquid and a gaseous headspace above the liquid, the bottle having a base and a stirrer bar of relatively low power magnetisation establishing opposite poles at opposite ends of the bar and extending parallel to the bottle base within the bottle, and a permanent magnet means of relatively high power providing spaced opposite poles in a plane parallel to the length of the stirrer bar located beneath the bottle base in close proximity thereto, and driving means for continuously rotating the permanent magnet means about an axis substantially normal to the bottle base so that its rotating strong magnetic field aligns with that of the stirrer bar and entrains the stirrer bar in continuous rotation in a plane parallel to and above the bottle base within the liquid in the container, thereby to disturb the liquid surface in order to promote gas exchange with the bottle headspace.

2. A stirrer as claimed in claim 1, wherein the stirrer bar is a low cost disposable magnet.

3. A stirrer as claimed in claim 2, wherein the stirrer bar is moulded wholly of ferrite in non-isotropic form.

4. A stirrer as claimed in claim 1, wherein the permanent magnet means comprises a pair of spaced, relatively high power magnets respectively with north and south poles adjacent the stirrer bar.

5. A stirrer as claimed in claim 4 wherein the permanent magnets extend generally normally to the base of the bottle with spaced centres, and the driving means acts to rotate the magnets about an axis parallel to the lengths of the magnets and generally central between said magnets.

6. A stirrer as claimed in claim 4 or 5, wherein the permanent magnet means comprises at least one relatively powerful rare earth magnet.

7. A stirrer as claimed in claim 6, wherein the at least one relatively powerful magnet is made of neodymium boron.

8. A method of magnetically stirring a liquid within a closed culture bottle which contains a gaseous headspace above the liquid, wherein a stirrer bar of relatively low power magnetisation establishing opposite poles at opposite ends of the bar is inserted into the bottle to extend parallel to the bottle base, a permanent magnet means of relatively high power providing spaced opposite poles in a plane parallel to the length of the stirrer bar is continuously driven in rotation beneath the bottle base in close proximity thereto and about an axis substantially normal to the bottle base, causing its rotating strong magnetic field to align with that of the stirrer bar and thereby entrain the stirrer bar in continuous rotation in a plane parallel to and above the bottle base within the liquid in the container, thereby to disturb the liquid surface in order to promote gas exchange with the bottle head space.

9. A method as claimed in claim 8, applied to the stirring of a hazardous liquid in a disposable bottle.

* * * * *